US006701117B2

(12) United States Patent
Kaji

(10) Patent No.: US 6,701,117 B2
(45) Date of Patent: Mar. 2, 2004

(54) IMAGE FORMING APPARATUS

(75) Inventor: Hajime Kaji, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/265,407

(22) Filed: Oct. 7, 2002

(65) Prior Publication Data

US 2003/0068180 A1 Apr. 10, 2003

(30) Foreign Application Priority Data

Oct. 9, 2001 (JP) ..... 2001-311495

(51) Int. Cl.[7] ..... G03G 15/01
(52) U.S. Cl. ..... 399/301; 347/116; 399/72
(58) Field of Search ..... 399/301, 49, 72; 347/116

(56) References Cited

U.S. PATENT DOCUMENTS 5,740,492 A * 4/1998 Deki et al. ..... 399/301
6,128,459 A * 10/2000 Iwata et al. ..... 399/301
6,137,517 A * 10/2000 Furst et al. ..... 347/116
6,327,453 B1 * 12/2001 Imaizumi et al. ..... 399/301
6,346,958 B2 * 2/2002 Kanno ..... 347/116
6,385,406 B1 5/2002 Funamizu et al. ..... 399/16

FOREIGN PATENT DOCUMENTS

JP 09185308 A * 7/1997 ..... G03G/15/01
JP 10198111 A * 7/1998 ..... G03G/15/01
JP 2000-98810 4/2000

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus including at least two image forming portions, a transferring portion for successively superimposing and transferring images formed by the image forming portions onto a transfer medium, a pattern forming portion for forming an image misregister detection pattern for detecting the positional deviation between the images formed by the image forming portions, a pattern detecting portion for detecting the image misregister detection pattern formed on the transfer medium by the pattern forming portion, a pattern position detecting portion for detecting the position of the image misregister detection pattern, and a positional deviation correcting portion for correcting the positional deviation of at least one of the image forming portions on the basis of the result of the detection of the pattern position detecting portion, wherein the pattern position detecting portion detects a time when the detection signal of the pattern detecting portion has been continuously outputted for a predetermined time and thereafter detects a time when the outputting of the detection signal has been stopped, to thereby detect the position of the image misregister detection pattern.

11 Claims, 10 Drawing Sheets

IMAGE FORMING APPARATUS

BACKGROUND OF THE INVENTION

1. Field of the Invention

The invention relates to an image forming apparatus adopting the electrophotographic process, the electrostatic recording process or the like, and particularly to an image forming apparatus using a transfer material transporting member and a transfer medium as an intermediate transfer member, and having the function of automatically correcting image misregister during image-on-image formation.

2. Description of Related Art

There has heretofore been proposed an image forming apparatus in which there are disposed a plurality of image forming means each for applying a laser beam modulated in conformity with recording information to a photosensitive drum which is an image bearing member or light emitted by a light emitting element such as an LED (light emitting diode), developing an electrostatic latent image formed on the photosensitive drum by the electrophotographic process and transferring a toner image of each color to transfer paper or an intermediate transfer belt, and the toner images of respective colors are multi-transferred on the transfer paper while the transfer paper is sequentially transported to the respective image forming means by a transfer material transporting belt or the toner images of respective colors are multi-transferred on the intermediate transfer belt, thereafter a color image can be formed by a method of collectively transferring the polychromatic toner images primary-transferred to the intermediate transfer belt to the transfer paper.

In the image forming apparatus of this type, there is a case where the positions (registrations) of the respective color images formed on the respective photosensitive drums are not registered with one another on the transfer material to which they are finally multi-transferred, for such reasons as the mechanical mounting errors among the photosensitive drums, the optical path length errors of the respective laser beams, the changes in the optical path and the warp of the LED by the environmental temperature.

Therefore, as shown in FIG. 2 of the accompanying drawings, an image misregister detection pattern 3 formed from each photo-sensitive drum onto the transfer material transporting belt or the intermediate transfer belt 31 which is a transfer medium is read by light sensors 2*a*, 2*b*, and the deviation of registration on the photosensitive drum corresponding to each color is detected, and electrical correction is effected on an image signal to be recorded and a turn-back mirror provided in the optical path of the laser beam is driven to thereby effect the correction of any change in the optical path length or any change in the optical path.

Various patterns have been proposed as the image misregister detection pattern 3, and for example, in Japanese Patent Application Laid-Open No. 2000-98810, there is proposed a pattern comprising a first segment disposed with a predetermined angle with respect to a process direction which is the direction of movement of a transfer belt and a second segment disposed axisymmetrically with the first segment with respect to an imaginary line orthogonal to the process direction.

FIG. 2 shows the manner in which the light sensors 2*a*, 2*b* detect the image misregister detection pattern 3 on the intermediate transfer belt 31 which is a belt member, and the image misregister detection pattern 3 is read by the light sensors 2*a*, 2*b* of an LED 4*a* which is a light emitting element and a phototransistor 4*b* which is a light receiving element. These light sensors 2*a*, 2*b* are disposed in two sets (2*a* and 2*b*) at a predetermined distance therebetween in a direction orthogonal to the process direction, and the image misregister detection pattern 3 is formed so as to pass on the light sensors 2*a*, 2*b*.

As the material of the intermediate transfer belt 31, use is made of a material of which the reflectance for the light (e.g. infrared light) applied from the LED 4*a* which is a light emitting element in the light sensors 2*a*, 2*b* is great as compared with the reflectance of the image misregister detection pattern 3, and by this difference in reflectance, the pattern detection of the image misregister detection pattern 3 is made possible.

FIG. 3 of the accompanying drawings shows a light receiving circuit 17 for reflecting the light applied from the LED 4*a* to the image misregister detection pattern 3 or the intermediate transfer belt 31, and converting the output signal when the reflected light thereof is received by the phototransistor 4*b* which is a light receiving element into an electrical signal.

In FIGS. 2 and 3, when a region of the intermediate transfer belt 31 is detected by the light sensors 2*a*, 2*b*, the quantity of reflected light is great and therefore a great deal of photocurrent passes through the phototransistor 4*b* and it is current/voltage-converted by a resistor 5, and is amplified by resistors 6, 7, 8 and an operational amplifier 9.

On the other hand, when the image misregister detection pattern 3 is detected by the light sensors 2*a*, 2*b*, the quantity of reflected light is small and therefore, a photocurrent small as compared with that in the region of the intermediate transfer belt 31 passes through the phototransistor 4*b*, and it is likewise current/voltage-converted by the resistor 5, and is amplified by the resistors 6, 7, 8 and the operational amplifier 9.

FIG. 4 of the accompanying drawings shows a state in which the light receiving circuit 17 has detected the reflected light in the order of a region of the intermediate transfer belt 31→the image misregister detection pattern 3→a region of the intermediate transfer belt 31. In FIG. 4, a threshold level Vt is set intermediately of a transfer belt detection level Va at which the intermediate transfer belt 31 has been detected by the light sensors 2*a*, 2*b* and a pattern detection level Vb at which the image misregister detection pattern 3 has been detected.

This threshold level Vt is set by a variable resistor 18 shown in FIG. 3, and by a voltage value outputted from the operational amplifier 9 after the photocurrent passing through the phototransistor 4*b* has been current/voltage-converted and the voltage value of the threshold level Vt set by the variable resistor 18 being compared with each other by a comparator 19, a pattern detection output 28 shown in FIG. 4 can be created.

Design is made such that the pattern detection output 28 sequentially sent is read, and the deviation of registration is detected from the width, interval or the like of the image misregister detection pattern 3 and electrical correction is effected on an image signal to be recorded and further, the turn-back mirror provided in the optical path of the laser beam is driven to thereby effect the correction of any change in the optical path length or any change in the optical path.

However, when in the aforedescribed example of the conventional art, an unexpected stain, scar or the like occurs on the intermediate transfer belt 31, reflectance is reduced on such portions and the reflected light may not be received in some cases by the phototransistor 4*b* in the light sensors 2*a*, 2*b*.

In that case, the stain or scar on the intermediate transfer belt 31 is recognized as the detection pattern 3, and the accurate width or interval of the image misregister detection pattern 3 cannot be read, and this has led to the problem that the deviation of registration cannot be corrected accurately.

SUMMARY OF THE INVENTION

The present invention solves the above-noted problem and the object thereof is to provides, in a construction for detecting an image misregister detection pattern, and on the basis of the result thereof, effecting the registration correction of image forming means, an image forming apparatus which is free from wrong detection due to the stain, scar or the like of a transfer medium and which precisely reads only the image misregister detection pattern to thereby effect highly accurate correction and realize a high quality of image.

A preferred form of the present invention for achieving the above object is an image forming apparatus comprising:

at least two image forming means;

transferring means for successively superimposing and transferring images formed by the image forming means onto a transfer medium;

pattern forming means for forming an image misregister detection pattern for detecting the positional deviation between the images formed by the image forming means;

pattern detection means for detecting the image misregister detection pattern formed on the transfer medium by the pattern forming means;

pattern position detecting means for detecting the position of the image misregister detection pattern from a detection signal obtained from the pattern detecting means; and positional deviation correcting means for correcting the positional deviation of at least one of the image forming means on the basis of the result of the detection of the pattern position detecting means;

wherein the pattern positional detecting means detects the time at a point of time whereat the detection signal of the pattern detecting means has been continuously outputted for a predetermined time, and the time at a point of time whereat thereafter the outputting of the detection signal has been stopped, to thereby detect the position of the image misregister detection pattern.

DETAILED DESCRIPTION OF THE PREFERRED EMBODIMENTS

As an example of an image forming apparatus according to the present invention, an embodiment in which the present invention is applied to a tandem type color image outputting apparatus having a plurality of image forming means arranged in a row will hereinafter be described specifically with reference to the drawings.

Figure 1:
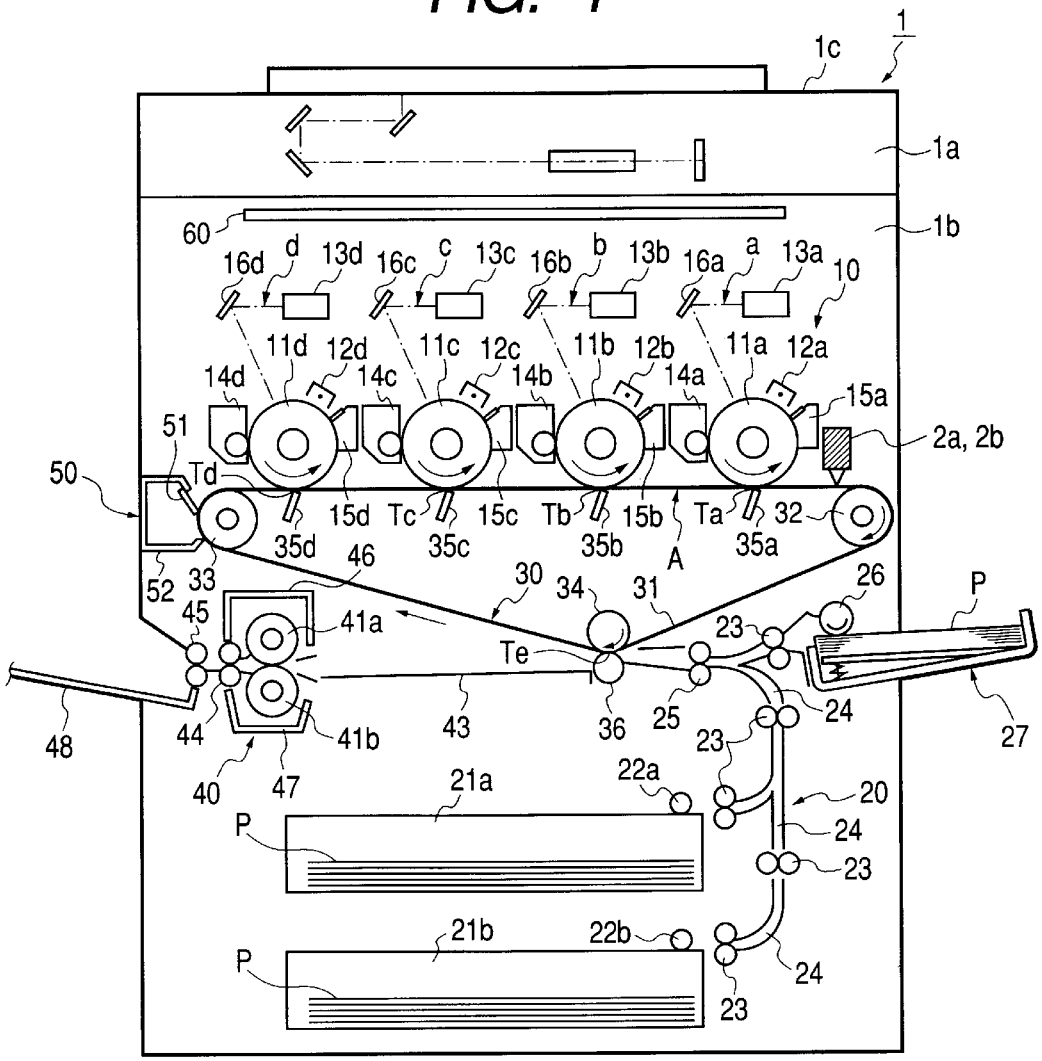
FIG. 1 is a cross-sectional illustration showing the construction of an image forming apparatus according to the present invention.

Referring to FIG. 1, the image forming apparatus 1 is of the electrophotographic type and is constructed as a so-called tandem type color image outputting apparatus having a plurality of image forming means arranged in a row.

The color image forming apparatus 1 shown in FIG. 1 comprises an image reading portion 1*a* and an image outputting portion 1*b*, and the image reading portion 1*a* optically reads the image of an original placed on a platen glass plate 1*c* or transported by an auto original feeder (not shown) and converts it into an electrical signal and sends it to the image outputting portion 1*b*.

The image outputting portion 1*b* is broadly divided into an image forming portion 10, in which four stations a, b, c and d as image forming means are juxtaposed and are the same in construction, a feed unit 20 for feeding transfer materials P contained in feed cassettes 21*a*, 21*b* and a manual feed tray 27, an intermediate transfer unit 30 for secondary-transferring to the transfer material P toner images primary-transferred to an intermediate transfer belt 31 which is a transfer medium and comprises an intermediate transfer member at the stations a, b, c and d, a fixing unit 40 for fixing the toner images secondary-transferred to the transfer material P, a cleaning unit 50 for removing any residual toners on the intermediate transfer belt 31, and a control unit 60 for comprehensively controlling these units.

In the image forming portion 10, photosensitive drums 11*a*, 11*b*, 11*c* and 11*d* as image bearing members are supported at the centers thereof and are rotatively driven in the directions indicated by the arrows in FIG. 1. Primary chargers 12*a*, 12*b*, 12*c*, 12*d*, optical systems 13*a*, 13*b*, 13*c*, 13*d*, turn-back mirrors 16*a*, 16*b*, 16*c*, 16*d* and developing devices 14*a*, 14*b*, 14*c*, 14*d* are disposed around the photosensitive drums 11*a* to 11*d* and in opposed relationship with the outer peripheral surfaces of the photosensitive drums 11*a* to 11*d*.

First, charges of a uniform charging amount are given to the surfaces of the photosensitive drums 11*a* to 11*d* by the primary chargers 12*a* to 12*d*, whereafter by the optical systems 13*a* to 13*d*, the photosensitive drums 11*a* to 11*d* are exposed to a light such as a laser beam modulated in conformity with a recording image signal to thereby form electrostatic latent images thereon.

Further, developers of four colors, i.e., yellow, cyan, magenta and black (hereinafter referred to the toners) are supplied to the electrostatic latent images by the developing devices 14*a* to 14*d* containing these toners therein to thereby visualize the electrostatic latent images.

Downstream of primary transfer areas Ta, Tb, Tc and Td for transferring the visualized visible images to the intermediate transfer belt 31 which is an intermediate transfer member, any residual toners left on the photosensitive drums 11*a* to 11*d* without being transferred to the transfer material P are scraped off by the cleaning devices 15*a*, 15*b*, 15*c* and 15*d* to thereby effect the cleaning of the surfaces of the photosensitive drums 11*a* to 11*d*. By the image forming process shown above, the image formation by the toners of the respective colors is sequentially effected.

The feed unit 20 is comprised of the feed cassettes 21*a*, 21*b* and the manual feed tray 27 for containing the transfer materials P therein, pickup rollers 22*a*, 22*b*, 26 for feeding the transfer materials P one by one from the feed cassettes 21*a*, 21*b* or the manual feed tray 27, a pair of feed rollers 23 and a feed guide 24 for transporting the transfer materials P fed by the pickup rollers 22*a*, 22*b*, 26 to a pair of registration rollers 25, and the pair of registration rollers 25 for feeding the transfer material P to a secondary transfer area Te in timed relationship with the image formation by the image forming portion 10.

The construction of the intermediate transfer unit 30 will now be described in detail. The intermediate transfer belt 31 which is a belt member is formed, for example, of PET (polyethylene terephthalate), PVdF (polyvinylidene fluoride) or the like, and is looped around a drive roller 32 for transmitting a rotative driving force to the intermediate transfer belt 31, a tension roller 33 for giving moderate tension to the intermediate transfer belt 31 by the biasing of a spring or the like (not shown) and a driven roller 34 opposed to the secondary transfer area Te with the intermediate transfer belt 31 interposed therebetween.

The intermediate transfer belt 31 has a primary transfer flat surface A formed between the drive roller 32 and the tension roller 33.

The drive roller 32 comprises a metal roller having its surface coated with rubber (e.g. urethane rubber or chloroprene rubber) having a thickness of several millimeters to thereby prevent the slip thereof relative to the intermediate transfer belt 31. Also, the drive roller 32 is rotatively driven by a pulse motor (not shown).

Primary transfer chargers 35*a*, 35*b*, 35*c*, and 35*d* are disposed on the backside of the intermediate transfer belt 31 at the primary transfer areas Ta, Tb, Tc, and Td in which the photosensitive drums 11*a* to 11*d* are opposed to the intermediate transfer belt 31.

A secondary transfer roller 36 is disposed in opposed relationship with the driven roller 34 with the intermediate transfer belt 31 interposed therebetween, and the secondary transfer area Te is formed by the nip portion thereof with respect to the intermediate transfer belt 31.

The secondary transfer roller 36 is urged against the intermediate transfer belt 31, which is a belt member and is an intermediate transfer member under a moderate pressure. Also, the cleaning unit 50 for cleaning the image forming surface of the intermediate transfer belt 31 is provided on the intermediate transfer belt 31 and downstream of the secondary transfer area Te in the direction of rotation of the intermediate transfer belt 31.

The cleaning unit 50 is provided with a cleaning blade 51 abutting against the surface of the intermediate transfer belt 31, and a waste toner box 52 for containing therein the residual toners scraped off by the cleaning blade 51.

The fixing roller 40 is comprised of a fixing roller 41*a* provided with a heat source such as a halogen heater therein, a pressure roller 41*b* urged against the fixing roller 41*a* (in some cases, the pressure roller 41*b* is also provided with a heat source therein), a transport guide 43 for guiding the transfer material P to the nip portion between the above-described pair of rollers 41*a* and 41*b*, fixing adiabatic covers 46, 47 for confining the heat of the fixing unit 40 therein, a pair of inner delivery rollers 44 and a pair of outer delivery rollers 45 for further directing the transfer material P delivered from the above-described pair of rollers 41*a* and 41*b* to the outside of the image forming apparatus 1, and a delivery tray 48 for stacking thereon the transfer materials P delivered to the outside of the apparatus.

Figure 9:
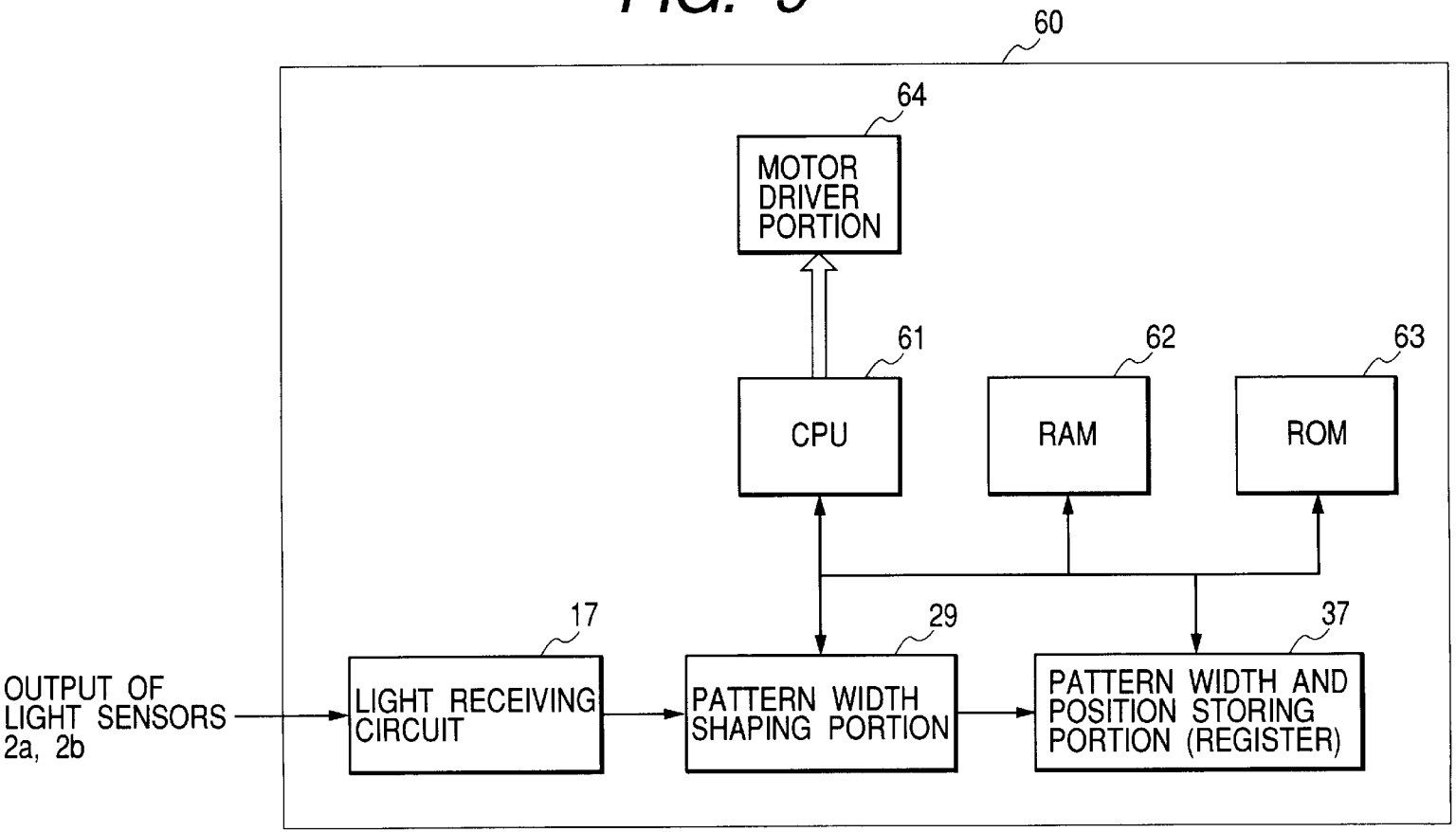
FIG. 9 is a block diagram showing the construction of a control system.

The control unit 60, as shown in detail in FIG. 9, is comprised of a CPU (central processing unit) 61 for controlling the operation of a mechanism in each of the above-described units, a RAM (random access memory) 62, a ROM (read only memory) 63, a motor driver portion 64, etc., and further a light receiving circuit 17, a pattern width shaping portion 29 and a pattern width and position storing portion (register) 37 which will be described later in detail.

The image forming operation of the image forming apparatus 1 will now be described in detail. When an image forming operation starting signal is generated from the CPU 61 shown in FIG. 9, the feeding operation is started from the feeding means selected in conformity with the selected paper size or the like of the transfer material P.

Describing a case where the transfer material has been fed, for example, from the upper feeding means shown in FIG. 1, the transfer materials P are first fed one by one from the feed cassette 21*a* by the pickup roller 22*a*. The transfer material P is then guided between the feed guides 24 by the pair of feed rollers 23 and is transported to the pair of registration rollers 25.

At that time, the pair of registration rollers 25 are at a stop and the leading edge of the transfer material P hits against the nip portion between the pair of registration rollers 25. Thereafter, the pair of registration rollers 25 start to be rotated in timed relationship with the start of the image formation by the image forming portion 10.

The rotation timing of the pair of registration rollers 25 is set so that the toner images primary-transferred onto the intermediate transfer belt 31 by the image forming portion 10 and the transfer material P may just be registered with each other in the secondary transfer area Te.

On the other hand, in the image forming portion 10, when an image forming operation starting signal is generated, the toner image formed on the photosensitive drum 11*d* lying most upstream in the direction of rotation of the intermediate transfer belt 31 by the aforedescribed image forming process is primary-transferred to the intermediate transfer belt 31 in the primary transfer area Td by a primary transfer charger 35*d* to which a high voltage is applied.

The primary-transferred toner image is transported to the next transfer area Tc. There is being effected there image formation with a delay of the time for which the toner image is transported between the adjacent ones of the image forming portions 10, and the next toner image is registered with and transferred onto the previous toner image. Thereafter a similar process is repeated and after all, the toner images of the four colors are successively primary-transferred on the intermediate transfer belt 31.

Thereafter, the transfer material P comes into the secondary transfer area Te and comes into contact with the intermediate transfer belt 31, whereupon a high voltage is applied to the secondary transfer roller 36 in timed relationship with the passage of the transfer material P.

Then, the toner images of the four colors formed on the intermediate transfer belt 31 by the aforedescribed image forming process are transferred to the surface of the transfer material P. Thereafter, the transfer material P is accurately guided to the nip portion between the fixing roller 41*a* and the pressure roller 41*b* by the transport guide 43.

The toner images are fixed on the surface of the transfer material P by the heat of the pair of rollers 41*a* and 41*b* and the pressure of the nip. Thereafter, the transfer material P is transported to the outside of the apparatus by the pair of inner and outer delivery rollers 44 and 45 and is stacked on the delivery tray 48.

The registration correcting operation will now be described with reference to the block diagram of the control unit shown in FIG. 9. The control unit 60 of FIG. 9 comprises the CPU 61 for controlling the image output portion 1*b*, the ROM 63 and RAM 62 for storing a control program and data therein, the motor driven portion 64 for driving various motors, the light receiving circuit 17 for receiving the output from the light sensors 2*a*, 2*b* shown in FIG. 2, and converting it into a waveform which can be processed by the pattern width shaping portion 29, the pattern width shaping portion 29 for receiving the output from the light receiving circuit 17 and shaping the pattern width of the image misregister detection pattern 3, and the pattern width and position storing portion (the registers D to S of FIG. 10) 37 for storing the pattern width and position of the image misregister detection pattern 3 therein.

Figure 2:
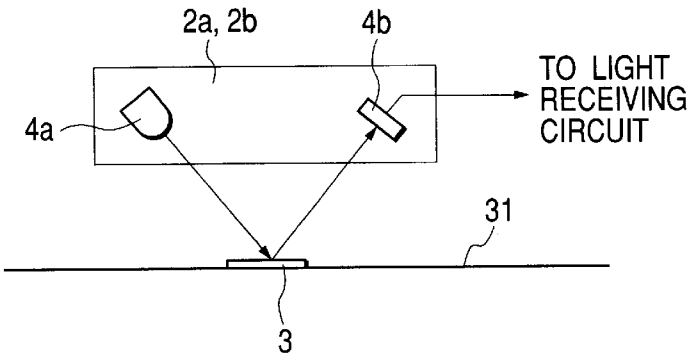
FIG. 2 is a typical illustration showing the manner in which an image misregister detection pattern on a belt member is read by a light sensor.
Figure 3:
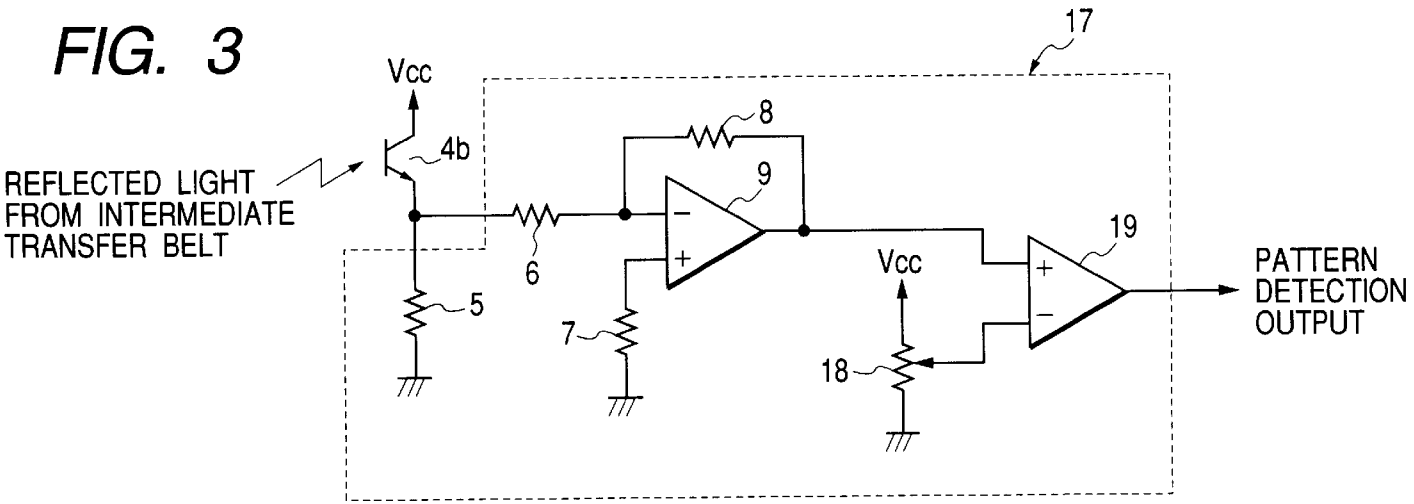
FIG. 3 shows the construction of a light receiving circuit for receiving the output of the light sensor.
Figure 4:
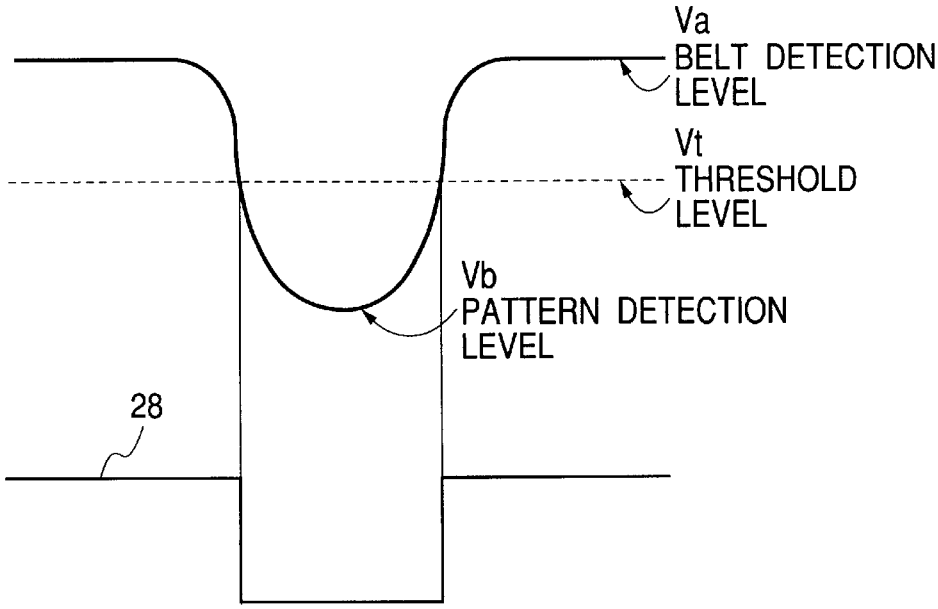
FIG. 4 shows the output of the light sensor and the pattern detection output of the light receiving circuit when the image misregister detection pattern has been read.

The registration correcting operation is started by the instructions from the CPU 61, and when the image misregister detection pattern 3 is detected, it is converted into an electrical signal by the light sensors 2*a*, 2*b* shown in FIG. 2 and the light receiving circuit 17 shown in FIG. 3, and is inputted to the pattern width shaping portion 29.

Figure 6:
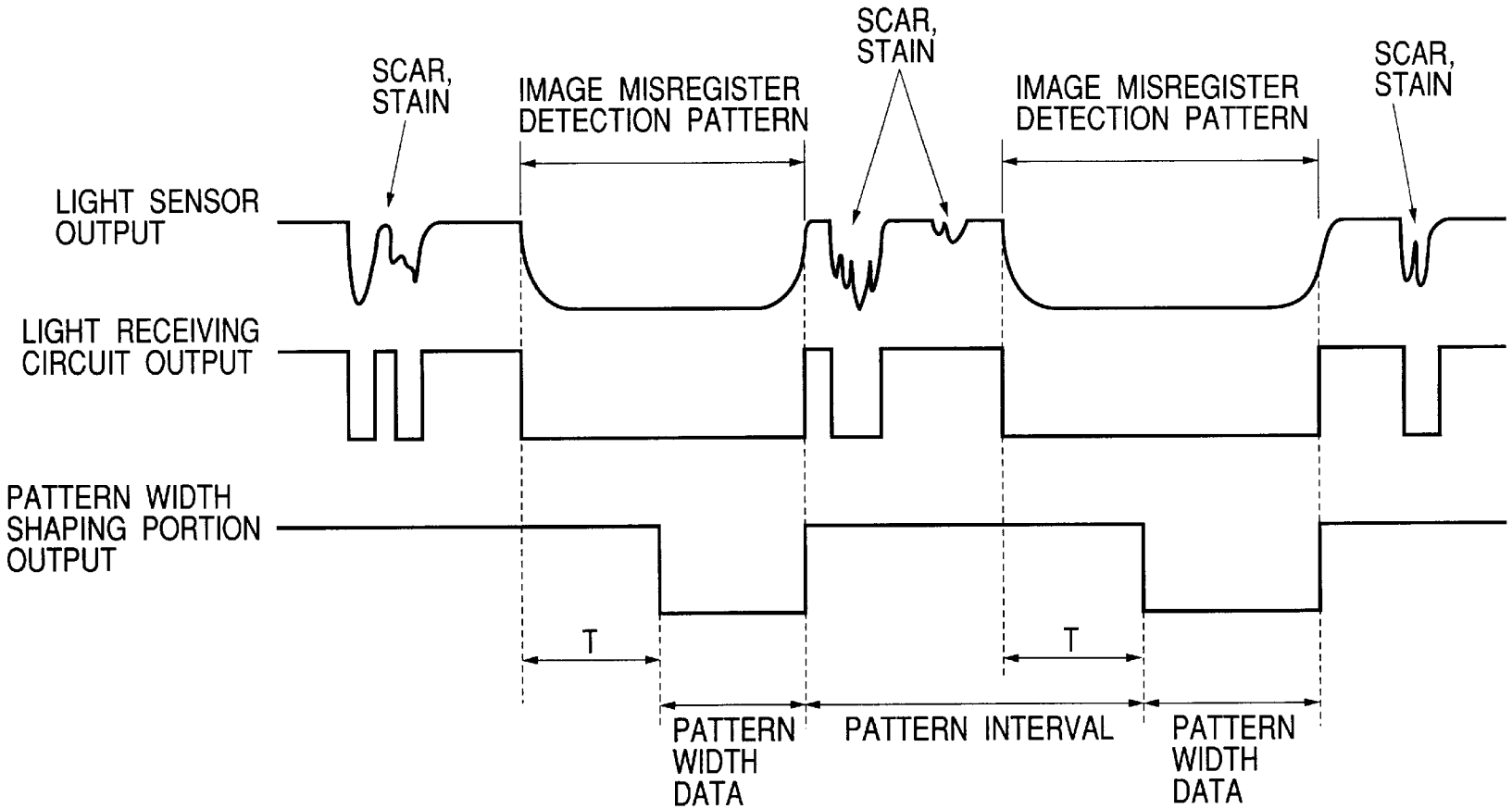
FIG. 6 is a timing chart when the data of the image misregister detection pattern are stored.

In the pattern width shaping portion 29, as shown in FIG. 6, only when the output continues for a predetermined time T set by the CPU 61 or longer, it is discriminated as the image misregister detection pattern 3, and the control of storing the pattern width and the pattern position in the pattern width and position storing portion (register) 37 is effected. This pattern width shaping portion 29 and the control of the pattern width and position storing portion 37 will be described later in detail.

The position of the pattern is detected on the basis of the data stored in the pattern width and position storing portion 37, and the deviation of registration on the photosensitive drums 11*a* to 11*d* corresponding to the respective colors is calculated by the use of a table or the like stored in the CPU61 and the ROM 63, and electrical correction is effected on an image signal to be recorded or the motor for controlling the turn-back mirrors 16*a* to 16*d* is drive-controlled by the motor driver portion 64 to thereby control the turn-back mirrors 16*a* to 16*d* provided in the optical path of the laser beam, and effect the correction of any change in the optical path length or any change in the optical path.

These correcting operations are suitably performed to the plurality of image forming means as required.

In the present embodiment, the photosensitive drums 11*a* to 11*d* which are a plurality of image forming means for forming images serve also as pattern forming means for forming the image misregister detection pattern 3 for correcting the misregister of the images formed by the photosensitive drums 11*a* to 11*d*, and pattern detecting means for detecting the image misregister detection pattern 3 uses light sensors 2*a*, 2*b* similar to the aforedescribed conventional ones.

The light sensors 2*a*, 2*b* have an LED 4*a* which is a light emitting element, and a phototransistor 4*b* which is a light receiving element, and are designed to output a signal when light emitted from the LED 4*a* is reflected by the intermediate transfer belt 31 which is a belt member looped in proximity to the photosensitive drums 11*a* to 11*d* which are the image forming means and rotatively driven and the quantity of reflected light received by the phototransistor 4*b* is a predetermined value or greater.

As registration correcting means for correcting the registration among the photosensitive drums 11*a* to 11*d* which are the image forming means on the basis of the result of the detection by pattern detecting means constituted by the light sensors 2*a*, 2*b*, the light receiving circuit 17, the pattern width shaping portion 29 and the pattern width and position storing portion 37, electrical correction is effected on the image signal to be recorded or the motor for controlling the turn-back mirrors 16*a* to 16*d* is drive-controlled by the motor driver portion 64 to thereby control the turn-back mirrors 16*a* to 16*d* provided in the optical path of the laser beam and effect the correction of any change in the optical path length or any change in the optical path.

A construction for accurately detecting the pattern width and interval of the image misregister detection pattern 3 even if a stain or a scar is on the intermediate transfer belt 31, which construction is to be said to be the feature of the present embodiment, will now be described with reference to the timing charts of FIGS. 6 and 7.

As regards an electrical signal outputted from the light receiving circuit 17 for receiving the output from the light sensors 2*a*, 2*b* shown in FIG. 2, and converting it into a waveform which can be processed by the pattern width shaping portion 29 shown in FIG. 9, the signal is outputted as in the case of the image misregister detection pattern 3 because reflectance also lowers when a scar or a stain is on the intermediate transfer belt 31.

So, a control is effected in a manner that the waveform due to the scar or the stain by the pattern is eliminated from the signal outputted from the light receiving circuit 17 by the width shaping portion 29, which is the pattern detecting means. When there is obtained an output from the light sensors 2*a*, 2*b* as shown, for example, in FIG. 6, such an output as will not reach a preset threshold level Vt can be eliminated by the light receiving circuit 17.

An output exceeding the threshold level Vt, however, cannot be eliminated by the light receiving circuit 17. So, in the pattern width shaping portion 29, control is effected by the use of a counter or the like so that no signal may be outputted until an inputted signal continues for the predetermined time T or longer.

By effecting this control, it becomes possible to eliminate a signal due to the scar or the stain or the like which is finer than the image misregister detection pattern 3. However, when the outputting of the signal has stopped, the signal is stopped at that point of time. This is because if it is not effected, there is the possibility that when there are many fine scars or stains, the signal will continue to be outputted. Thereby, as a waveform of the pattern width of the image misregister detection pattern 3 and other width due to a scar or a stain or the like, it becomes possible to obtain a pattern width shaping portion output signal from the pattern width shaping portion 29, as shown in FIG. 6.

The data storing timing in the pattern width and position storing portion (register) 37 will now be described with reference to FIG. 7. On the basis of the pattern width shaping portion output signal obtained by the pattern width shaping portion 29 shown in FIG. 7, the counter is operated and further, a latch timing signal is generated and data are stored.

Figure 5:
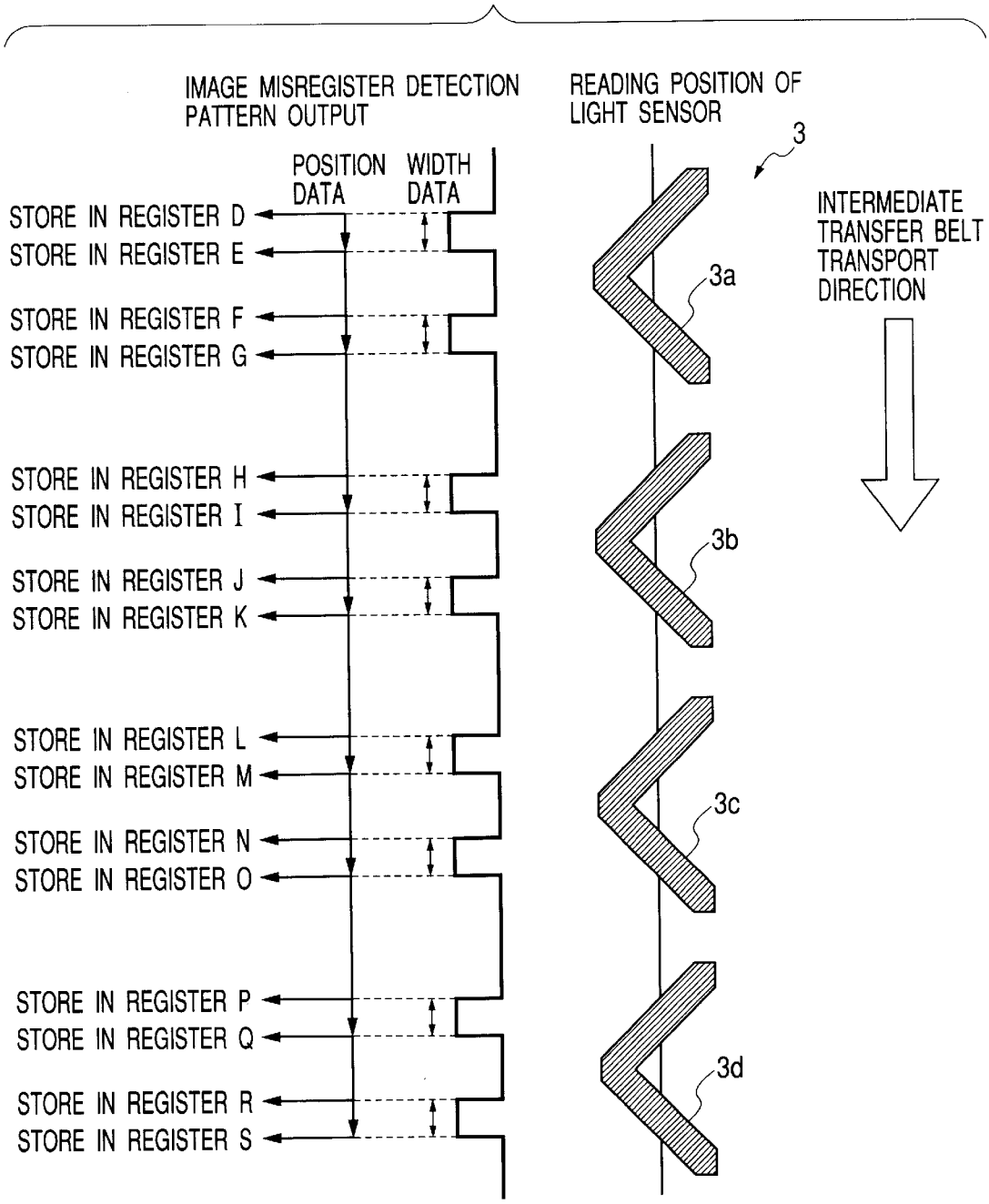
FIG. 5 shows an example of the image misregister detection pattern formed on the belt member.
Figure 7:
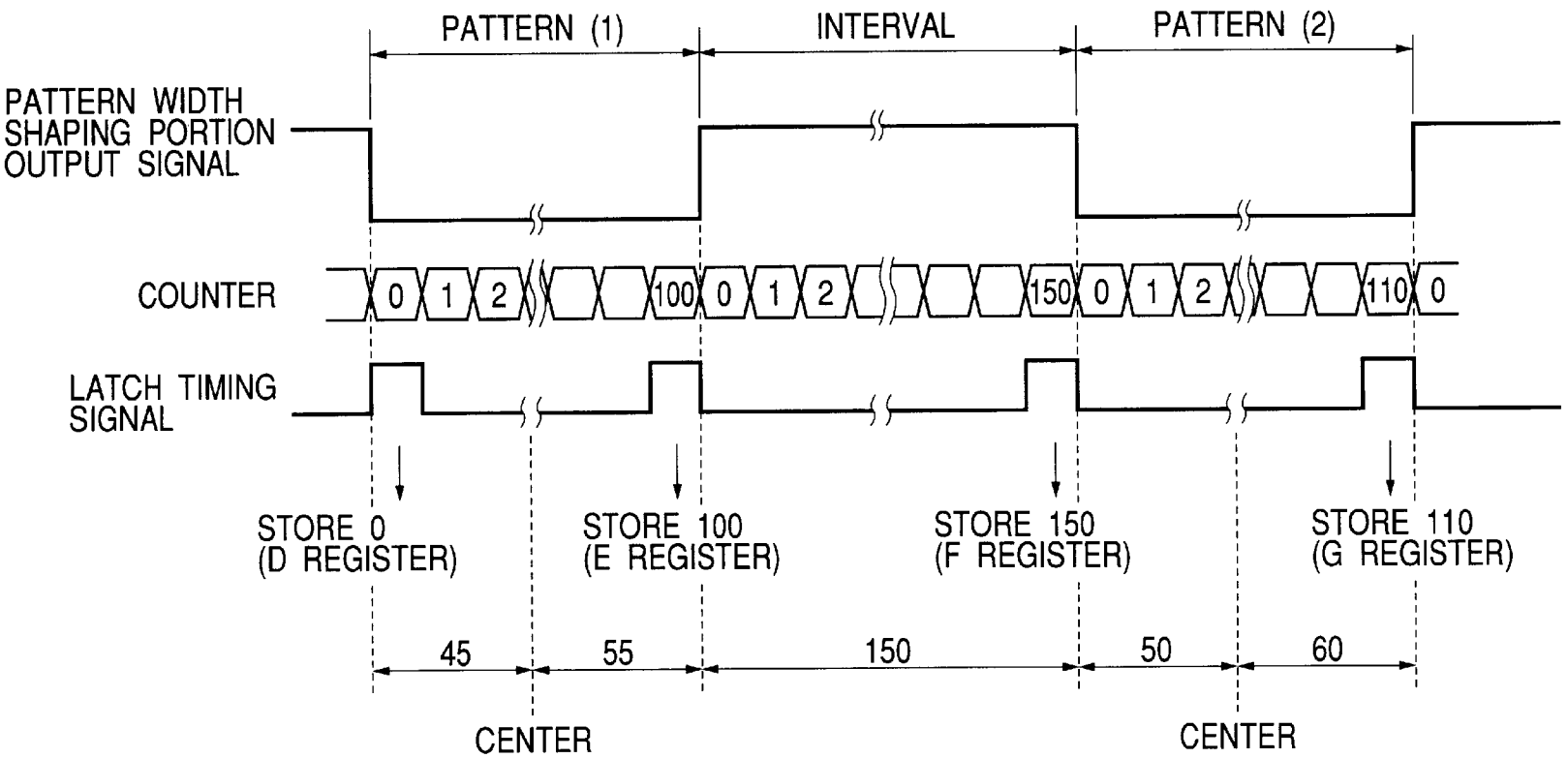
FIG. 7 is a timing chart when the data of the image misregister detection pattern are stored.
Figure 10:
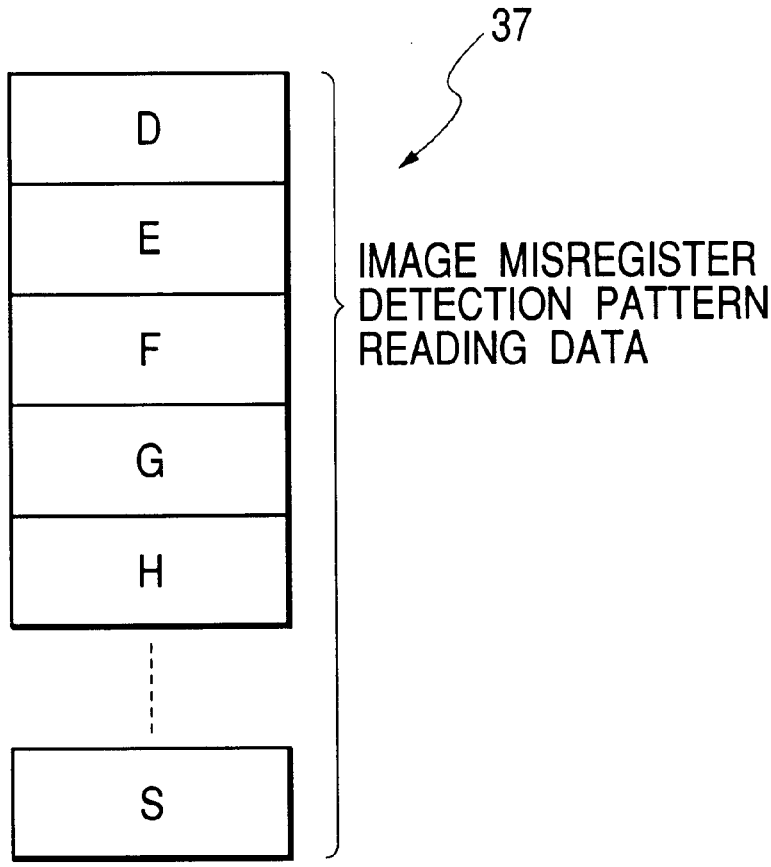
FIG. 10 shows the constructions of a pattern width and position storing portion.

When for example, the image misregister detection pattern 3 as shown in FIG. 5 is obtained by a signal as shown in FIG. 7, a counter value "0" is stored in the D register of the pattern width and position storing portion 37 shown in FIG. 10.

Subsequently, the storing of counter value data into respective registers is effected in such a manner that "100" is stored in E register, "150" is stored in F register, "110" is stored in G register, and so on. By these data, it is possible to detect the pattern width and further, the pattern interval of the image misregister detection pattern 3, and it also becomes possible to find the absolute position (the position of the pattern) from a signal detected at first.

However, it must be considered in calculation that in the pattern width shaping portion 29, the actual sensor output by the light sensors 2*a*, 2*b* is delayed by a time T that is a predetermined time.

For example, assuming that the waveform shown in FIG. 7 is the output waveform when it has been set as being delayed by 10(T=10) in terms of the counter value, the width of the pattern (1) is 110 counts. Also, the pattern (2) has a pattern width of 120 counts (110 counts+10(=T) counts), and the absolute distance of the central value of the pattern (2) from the central value of the pattern (1) is 255 counts (pattern (1) (55 counts)+interval (150 counts)+pattern (3)(50 counts)).

Such a count value correcting operation can be performed to the data stored in the register 37 by the CPU 61, which is control means, for example, during the registration correcting operation of the CPU 61. Thus, by this count value correcting operation being performed, the position of the pattern can be detected.

By the above-described control, it becomes possible to prevent the wrong detection of the image misregister detection pattern 3 due to a scar or a stain on the intermediate transfer belt 31, and accurately detect the pattern width and interval and position of the image misregister detection pattern 3.

That is, in the present embodiment, when in the pattern width shaping portion 29 which is pattern detecting means, the time for which the signal from the light sensors 2*a*, 2*b* is outputted is to be read by the counter, the counting of the time is started at a point of time whereat the signal from the light sensors 2*a*, 2*b* has been continuously outputted for the predetermined time T, and the count value of that time is read at a point of time whereat the signal output from the light sensors 2*a*, 2*b* has been stopped.

Also, when the time for which the signal from the light sensors 2*a*, 2*b* is not outputted is to be read by the counter, the counting of the time is started at the point of time whereat the signal output from the light sensors 2*a*, 2*b* has been stopped, and the count value of that time is read at the point of time whereat the signal has been continuously outputted for the predetermined time T.

Figure 8:
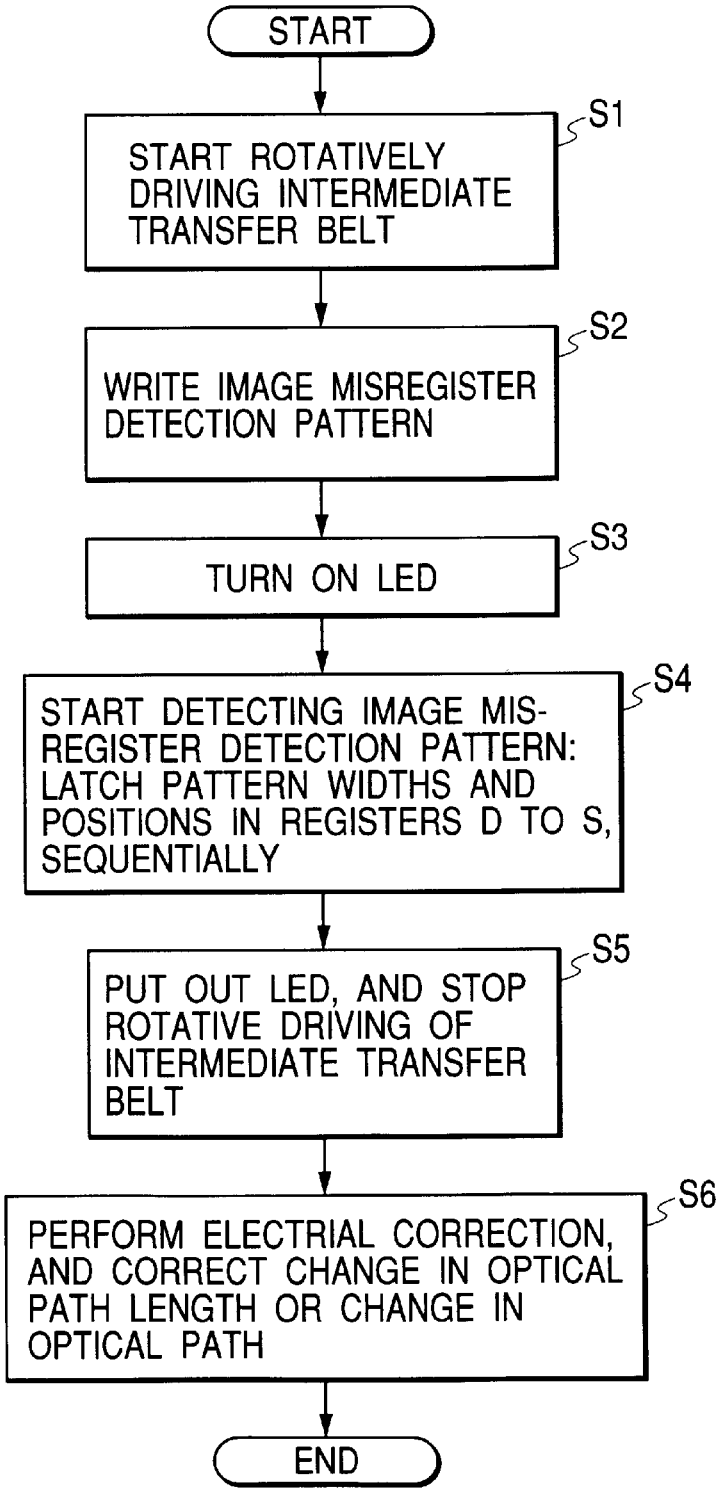
FIG. 8 is a flowchart illustrating the registration correcting operation.

Reference is now had to the flowchart of FIG. 8 to describe the registration correcting operation sequence by the registration correcting means for correcting the registration of the photosensitive drums 11*a* to 11*d* which are the image forming means on the basis of the result of the detection by the pattern width shaping portion 29 which is the above-described pattern detecting means.

The CPU 61 shown in FIG. 9 performs the registration correcting operation, for example, when the power supply switch of the image forming apparatus 1 is closed or when a predetermined time has passed after the power supply switch is closed.

When the registration correcting operation is started, the intermediate transfer belt 31 is rotatively driven at a step S1 shown in FIG. 8, and at a step S2, the writing of the image misregister detection pattern 3 onto the intermediate transfer belt 31 is started by the photosensitive drums 11*a* to 11*d*. The LED 4*a* is turned on (step S3) before the image misregister detection pattern 3 written onto the intermediate transfer belt 31 passes the light sensors 2*a*, 2*b*, and at a step S4, the detecting operation for the image misregister detection pattern 3 is started.

At the step S4, as previously described, the signal from the light sensors 2*a*, 2*b* is passed through the light receiving circuit 17 and the pattern width shaping portion 29 for shaping the pattern width of the image misregister detection pattern 3 to thereby eliminate the wrong detection signal due to a scar or a stain or the like, and the pattern widths and positions of the image misregister detection pattern 3 are sequentially stored in registers D to S shown in the pattern width and position storing portion (register) 37.

At a step S5, the LED 4*a* is turned off and the rotative driving of the intermediate transfer belt 31 is stopped, and the pattern width and interval detecting operation is terminated and advance is made to a step S6, where electrical correction is effected on the image signal to be recorded on the basis of the data stored in the aforementioned registers D to S and the table or the like stored in the ROM 63, and the turn-back mirrors 16*a* to 16*d* provided in the optical path of the laser beam are driven to thereby effect the correction of any change in the optical path length or any change in the optical path, thus terminating the registration correcting operation.

For example, FIG. 5 shows a state in which the image misregister detection patterns 3 are read and output thereof are stored. The position data and width data of a image misregister detection pattern 3*a* are stored in the registers D, E, F and G on the basis of an image misregister detection pattern output obtained by the light sensors 2*a*, 2*b* reading the image misregister detection pattern 3*a*.

Likewise, the position data and width data of image misregister detection patterns 3*b* to 3*d* are stored in registers H to S, respectively, on the basis of image misregister detection pattern outputs obtained by the light sensors 2*a*, 2*b* reading the image misregister detection patterns 3*b* to 3*d*.

Also, while in the present embodiment, description has been made of the registration correcting process in the intermediate transferring process (collectively transferring process) by the intermediate transfer belt 31 on which images are formed by the photosensitive drums 11*a* to 11*d* which are the image forming means, of course the present invention is also effectively applicable to the multi-transfer process by a transfer material transporting belt which is transfer material transporting means for transporting the transfer materials P on which images are formed by the image forming means.

Figure 11:
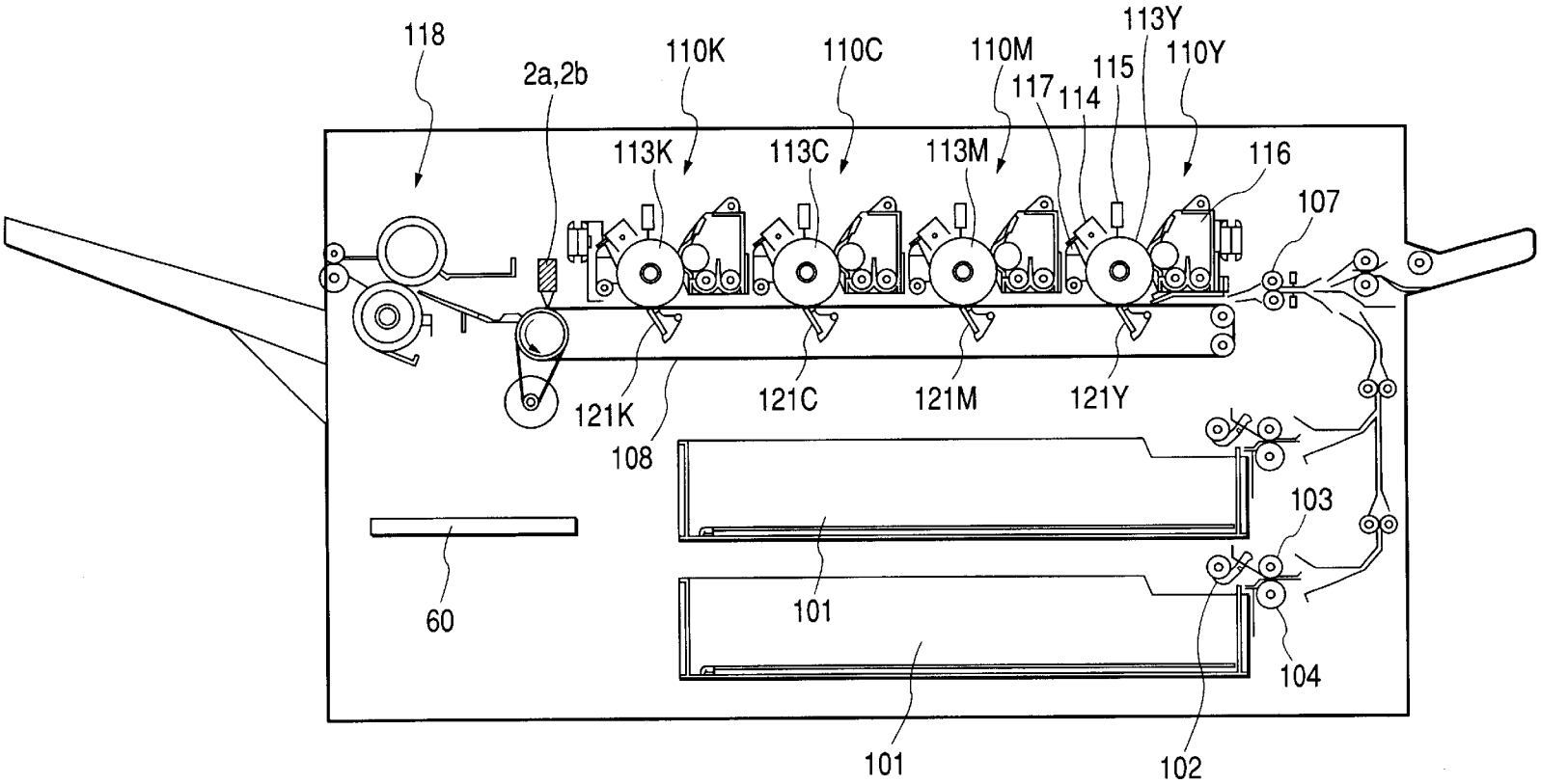
FIG. 11 shows another form of the image forming apparatus to which the present invention is applied.

FIG. 11 shows another form of the image forming apparatus to which the present invention is applicable, and this apparatus uses a transfer material transporting belt, which is a transfer material transporting member. In this apparatus, toner images formed by a plurality of image forming means 110Y to 110K are successively superimposed and transferred onto a transfer material borne on and transported by a transfer material transporting belt 108, whereby a color image is formed. Describing the image forming means 110Y in detail, an electrostatic latent image is formed on the surface of an image bearing member 113Y uniformly charged by primary charging means 114, by the exposure by exposing means 115, and this latent image is developed as a toner image by developing means 116. This toner image is transferred to a transfer material by transferring means 121Y, and any untransferred toner is collected by a cleaner 117.

The transfer material fed from a cassette 101 by feeding means 102, 103, and 104 starts to be fed by registration rollers 107 in synchronism with the image formation timing in the image forming means, and is borne on and transported by the transfer material transporting belt 108 and at the same time, toner images formed by the image forming means 110Y to 110K are successively superimposed and transferred onto the transfer material. After the transfer of all toner images is terminated, the transfer material is separated from the belt 108, and the fixing of the toner images is effected by fixing means 118.

In such an image forming apparatus, for the registration of the images among the image forming means, an image misregister detection pattern is formed on the transfer material transporting belt 108 and the detection thereof by the light sensors 2*a*, 2*b* is effected. During this detection, the method shown in the previous description is used.

While in the aforedescribed embodiment, description has been made of a case where the time until the signal of the pattern width shaping portion 29 is outputted is defined as the predetermined time T and set as a fixed value, it becomes possible for the CPU 61 of the control unit 60 to perform the detecting operation for detecting any stain or scar on the intermediate transfer belt 31 prior to performing the operation of detecting the image misregister detection pattern 3, detect in advance the time during which the scar or stain can be removed, and determine the time T until the signal of the pattern width shaping portion 29 is outputted, to thereby enhance accuracy.

That is, before the correction of the registration of the photosensitive drums 11*a* to 11*d* which are the image forming means is effected by registration correcting means, the scar or stain detecting operation for detecting any scar or stain on the intermediate transfer belt 31 which is a belt member is performed by the light sensors 2*a*, 2*b* which are pattern detecting means, and in conformity with the width of the scar or stain detected by the pattern detecting means, the predetermined time T regarding the reading of the pattern detecting means is controlled.

For example, the detecting operation for the surface of the belt is performed while the belt is moved in a state in which the formation of the image misregister detection pattern 3 is not effected. If at this time, there is a signal detected by the length of a time T' exceeding the time T, the scar or stain will be wrongly detected if the value of the time T remains unchanged. So, by changing the value of this time T to a value exceeding T', it is possible to prevent the wrong detection due to the scar or stain.

What is claimed is:

1. An image forming apparatus comprising:

at least two image forming means;

transferring means for successively superimposing and transferring images formed by said image forming means onto a transfer medium;

pattern forming means for forming an image misregister detection pattern for detecting a positional deviation between the images formed by said image forming means;

pattern detecting means for detecting the image misregister detection pattern formed on said transfer medium by said pattern forming means;

pattern position detecting means for detecting a position of said image misregister detection pattern from a detection signal obtained from said pattern detecting means; and positional deviation correcting means for correcting a positional deviation of at least one of said image forming means based on a detection result of said pattern position detecting means, wherein said pattern position detecting means detects a time when the detection signal from said pattern detecting means has been continuously outputted for a predetermined time and thereafter detects a time when outputting of the detection signal has been stopped, to thereby detect the position of said image misregister detection pattern.

2. An image forming apparatus according to claim 1, wherein said pattern position detecting means counts an elapsed time from the time when the detection signal has been continuously outputted for the predetermined time to the time when the outputting of said detection signal has been stopped.

3. An image forming apparatus according to claim 2, wherein said pattern position detection means counts an elapsed time from the time when the outputting of said detection signal has been stopped to a time when a next detection signal has been continuously outputted for the predetermined time.

4. An image forming apparatus according to claim 2, wherein said pattern position detecting means detects the position of said image misregister detection pattern based on a value obtained by adding the predetermined time to the elapsed time from the time when the detection signal has been continuously outputted for the predetermined time to the time when the outputting of said detection signal has been stopped.

5. An image forming apparatus according to claim 1, wherein said pattern detecting means has a light emitting element and a light receiving element, and receives, by said light receiving element, a reflected light of a light applied by said light emitting element to thereby detect said image misregister detection pattern.

6. An image forming apparatus according to claim 5, wherein said pattern detecting means outputs the detection signal when an intensity of the reflected light is a predetermined value or greater.

7. An image forming apparatus according to claim 1, wherein said pattern detecting means performs a transfer medium state detecting operation of detecting a state of a scar or a stain on said transfer medium, and the predetermined time is changed in accordance with a result of the transfer medium state detecting operation.

8. An image forming apparatus according to claim 7, wherein, in the transfer medium state detecting operation, when a maximum value of a time for which the detection signal of said pattern detecting means is continuously outputted is greater than the predetermined time, the predetermined time is changed to a value exceeding the maximum value.

9. An image forming apparatus according to claim 8, wherein the transfer medium state detecting operation is performed in a state in which said image misregister detection pattern is not formed on said transfer medium.

10. An image forming apparatus according to claim 1, wherein said transfer medium is an intermediate transfer member, and the images formed by said image forming means are successively superimposed and transferred onto said intermediate transfer member, and thereafter are collectively transferred onto a transfer material.

11. An image forming apparatus according to claim 1, wherein said transfer medium is a transfer material transporting member for transporting a transfer material, and the images formed by said image forming means are successively superimposed and transferred onto the transfer material transported by said transfer material transporting member.

* * * * *

UNITED STATES PATENT AND TRADEMARK OFFICE

CERTIFICATE OF CORRECTION

PATENT NO. : 6,701,117 B2
DATED : March 2, 2004
INVENTOR(S) : Hajime Kaji

It is certified that error appears in the above-identified patent and that said Letters Patent is hereby corrected as shown below:

Title page,
Item [56], References Cited, FOREIGN PATENT DOCUMENTS, "JP 09185308 A * 7/1997 ….. G03G/15/01"; should read -- JP 9-1853028 A * 7/1997 ….. G03G/15/01-- ; and "JP 10198111 A * 7/1998 ….. G03G/15/01" should read
-- JP 10-198111 A * 8/1998 …… G03G/15/01 --.

Drawings,
Sheet No. 7, Figure 8, "ELECTRIAL" should read -- ELECTRICAL --.

Column 3,
Line 9, "provides," should read -- provide, --.

Signed and Sealed this

Sixth Day of July, 2004

JON W. DUDAS
*Acting Director of the United States Patent and Trademark Office*